US009757966B2

(12) United States Patent
Pierce et al.

(10) Patent No.: US 9,757,966 B2
(45) Date of Patent: Sep. 12, 2017

(54) PRINTER HEAD CLEANER ASSEMBLY

(71) Applicant: Sympateco, Inc., Omaha, NE (US)

(72) Inventors: James Pierce, Omaha, NE (US); Nathan Davis, Omaha, NE (US)

(73) Assignee: Sympateco, Inc., Omaha, NE (US)

( * ) Notice: Subject to any disclaimer, the term of this patent is extended or adjusted under 35 U.S.C. 154(b) by 0 days.

(21) Appl. No.: 14/996,545

(22) Filed: Jan. 15, 2016

(65) Prior Publication Data

US 2017/0203595 A1 Jul. 20, 2017

(51) Int. Cl.
*B41J 29/17* (2006.01)
*B41J 2/165* (2006.01)

(52) U.S. Cl.
CPC ..... *B41J 29/17* (2013.01)

(58) Field of Classification Search
CPC .. B41J 29/17; B41J 2/16517; B41J 2/216552; B41J 2002/1657
See application file for complete search history.

(56) References Cited

U.S. PATENT DOCUMENTS 681,035 A 8/1901 Blake
2010/0129131 A1* 5/2010 Liu ..... B43K 5/005 401/109
2015/0057637 A1* 2/2015 Herr ..... A61M 5/3202 604/506

OTHER PUBLICATIONS http://www.garrettwade.com/archimedes-screw-drills/p/88H11.10/.

* cited by examiner

*Primary Examiner* — Jason Uhlenhake
(74) *Attorney, Agent, or Firm* — Ryan T. Grace; Advent, LLP

(57) ABSTRACT

A printer head cleaner can include a housing and a plunger coupled to the housing. The plunger can include a bit retainer and a pusher. The bit retainer is configured to retain a bit. The pusher can advance the bit with respect to the housing and/or rotate the bit when pressure is applied to the plunger. In some implementations, the housing defines one or more registration features that can register a printer head with respect to the housing so that the bit is guided while advancing into the nozzle of a printer head.

20 Claims, 4 Drawing Sheets

PRINTER HEAD CLEANER ASSEMBLY

BACKGROUND

The term "3D printing," also known as additive manufacturing, refers to various processes used to synthesize a three-dimensional (3D) object. In 3D printing, successive layers of material are laid down under computer control. 3D printing processes can include sequentially depositing material onto a powder bed with an inkjet printer head, as well as extrusion and sintering-based processes. 3D printer heads can become blocked or clogged.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Aspects of the disclosure relate to a printer head cleaner (e.g., configured as a drill assembly) that includes a housing and a plunger coupled to the housing. The plunger can include a bit retainer configured to retain a bit, and a pusher. The pusher can advance the bit with respect to the housing and/or rotate the bit when pressure is applied to the plunger. In some implementations, the housing defines one or more registration features that can register a printer head with respect to the housing so that the bit may be guided while advancing into the nozzle of a printer head.

DRAWINGS

The Detailed Description is described with reference to the accompanying figures.

DETAILED DESCRIPTION

Figure 1:
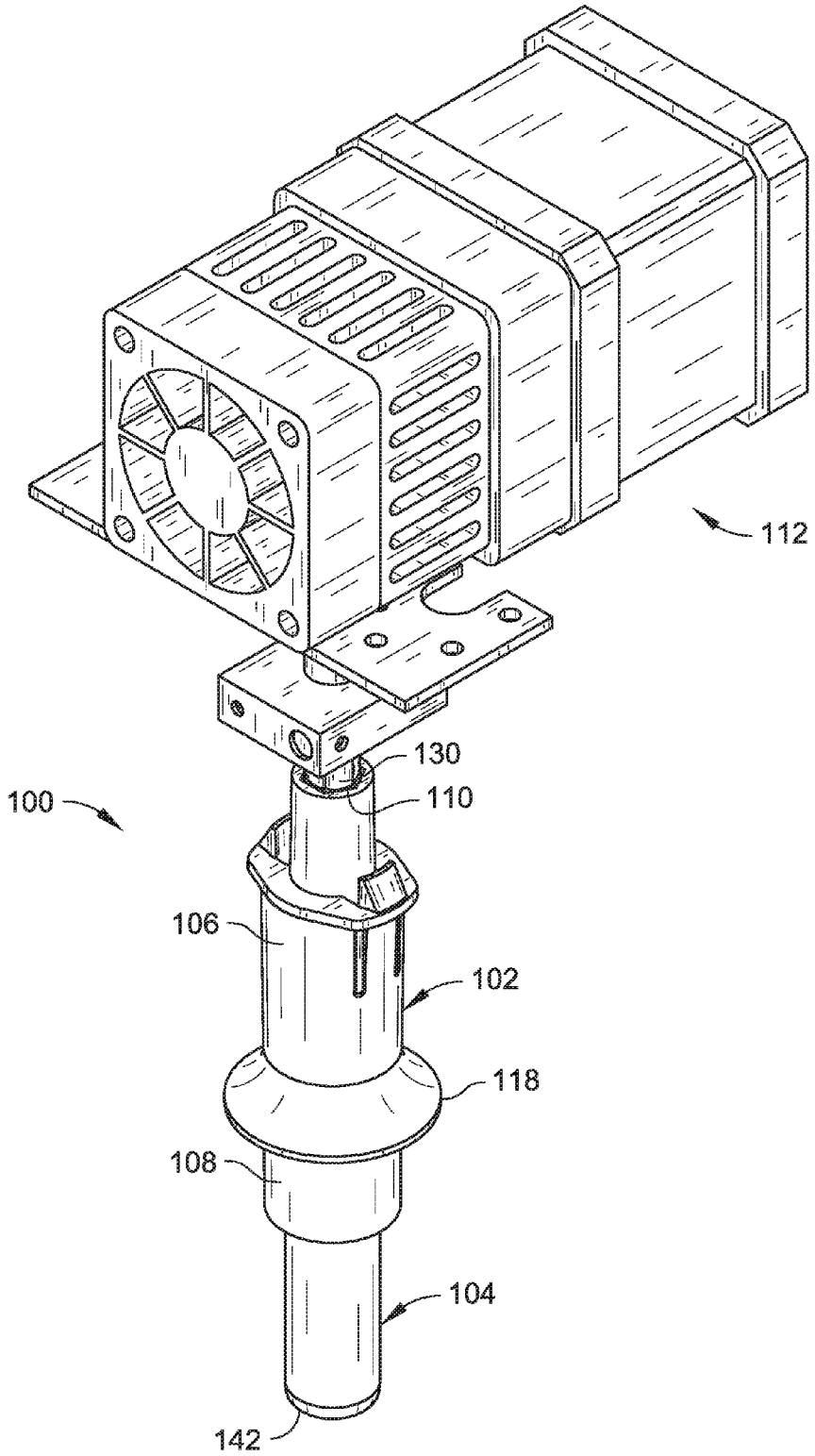
FIG. 1 is an isometric view illustrating a printer head cleaner in registered engagement with a printer head in accordance with an example embodiment of the present disclosure.

Aspects of the disclosure are described more fully hereinafter with reference to the accompanying drawings, which form a part hereof, and which show, by way of illustration, example features. The features can, however, be embodied in many different forms and should not be construed as limited to the combinations set forth herein; rather, these combinations are provided so that this disclosure will be thorough and complete, and will fully convey the scope. The following detailed description is, therefore, not to be taken in a limiting sense.

3D printer heads require periodic cleaning to prevent blockages and clogs. For example, many 3D printers use thermoplastic filament that is fed into a hot end of the printer head that melts the filament. The melted filament can get caught in the printer head nozzle, clogging the printer head. Drills and drill bits can be utilized to unblock printer head nozzles. However, using the wrong type/size of drill and/or drill bit, or inserting the drill bit improperly, may damage the printer head nozzle.

Accordingly, the present disclosure is directed to a drill assembly that includes a housing and a plunger coupled to the housing. The plunger can include a bit retainer and a pusher. The bit retainer is configured to retain a bit. The pusher can advance the bit with respect to the housing and/or rotate the bit when pressure is applied to the plunger. In some implementations, the housing includes a registration feature that can register a printer head with respect to the housing, so that the bit may advance into the nozzle of the printer head.

Referring now to FIGS. 1 through 4, drill assemblies 100 are described. As shown, a drill assembly 100 includes a housing 102 coupled to a plunger 104. In embodiments, the housing 102 can be composed of a variety of materials, including, but not necessarily limited to: metal, plastic, and so forth.

With reference to FIG. 1, a drill assembly 100 can be configured as a printer head cleaner. The housing 102 can have a first end 106 and a second end 108. In some implementations, the first end 106 includes a registration feature 110. The registration feature 110 can register, for example, a printer head 112 with respect to the housing 102. The registration feature 110 can have a shape configured to match the shape of the extruder tip of the printer head 112. For example, in an embodiment where the printer head 112 has a hexagonally-shaped extruder tip, the printer head cleaner can have a hexagonally-shaped socket that receives the tip of the printer head 112. However, the hexagonal configuration is offered by way of example only and is not meant to be restrictive of the present disclosure. In other embodiments, the registration feature 110 can be configured in other shapes (e.g., circular, square, triangular, etc.) to register printer head tips having different shapes.

Figure 2:
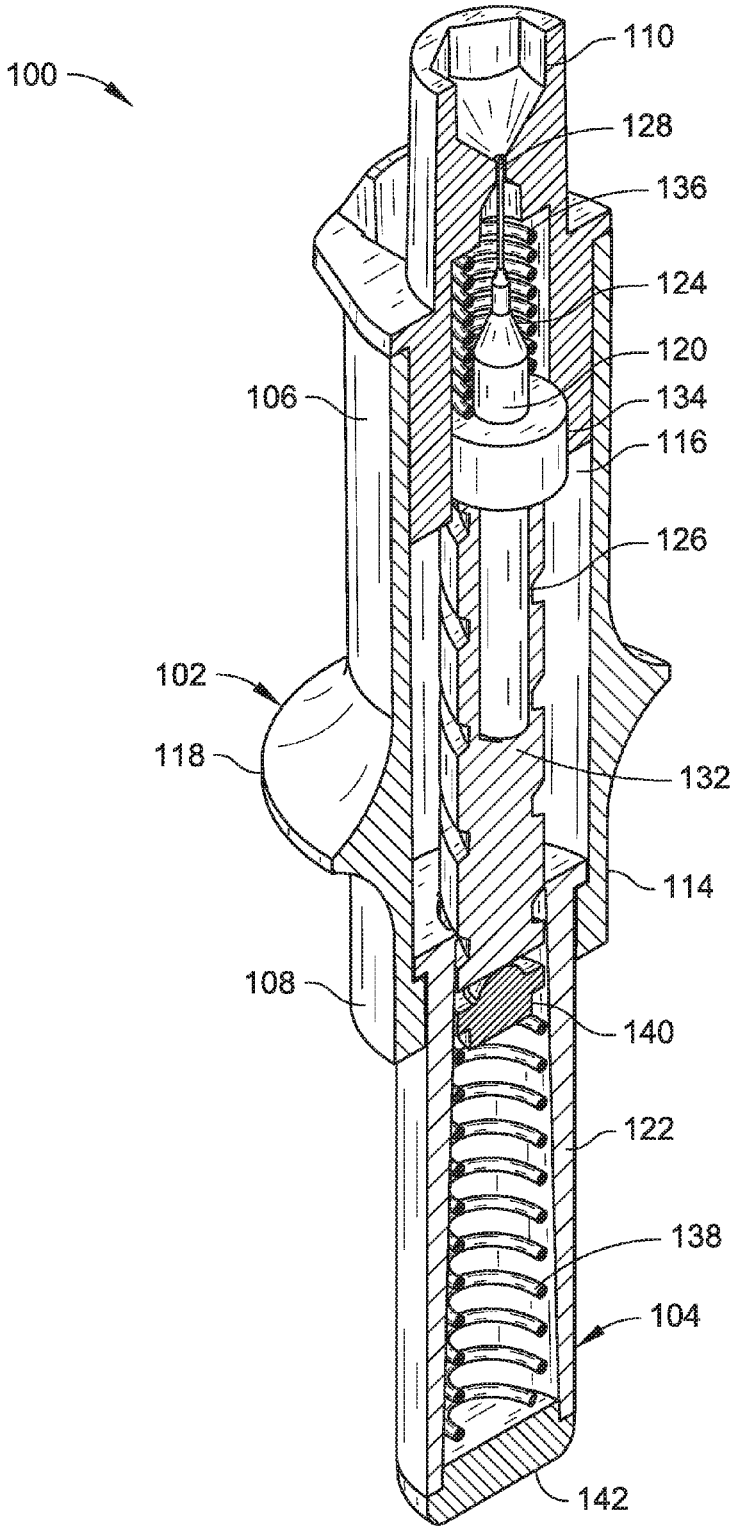
FIG. 2 is a partial cross-sectional isometric view of a drill assembly, such as the printer head cleaner shown in FIG. 1, in accordance with an example embodiment of the present disclosure.
Figure 3:
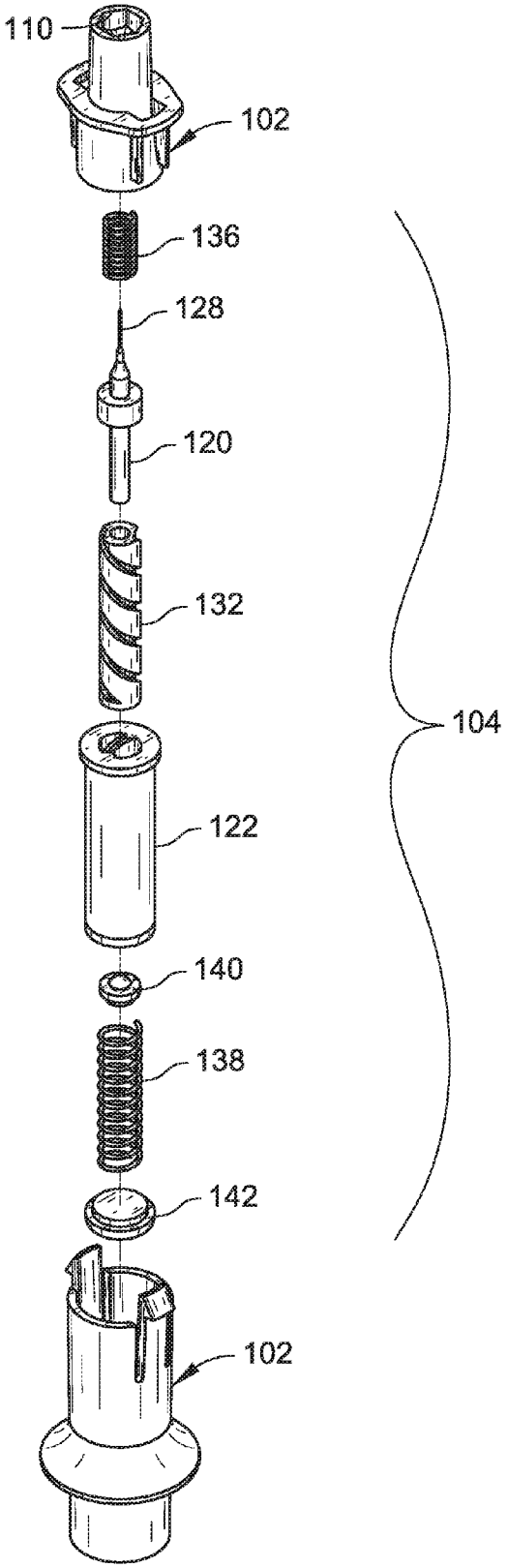
FIG. 3 is an exploded isometric view of the drill assembly illustrated in FIG. 2.
Figure 4:
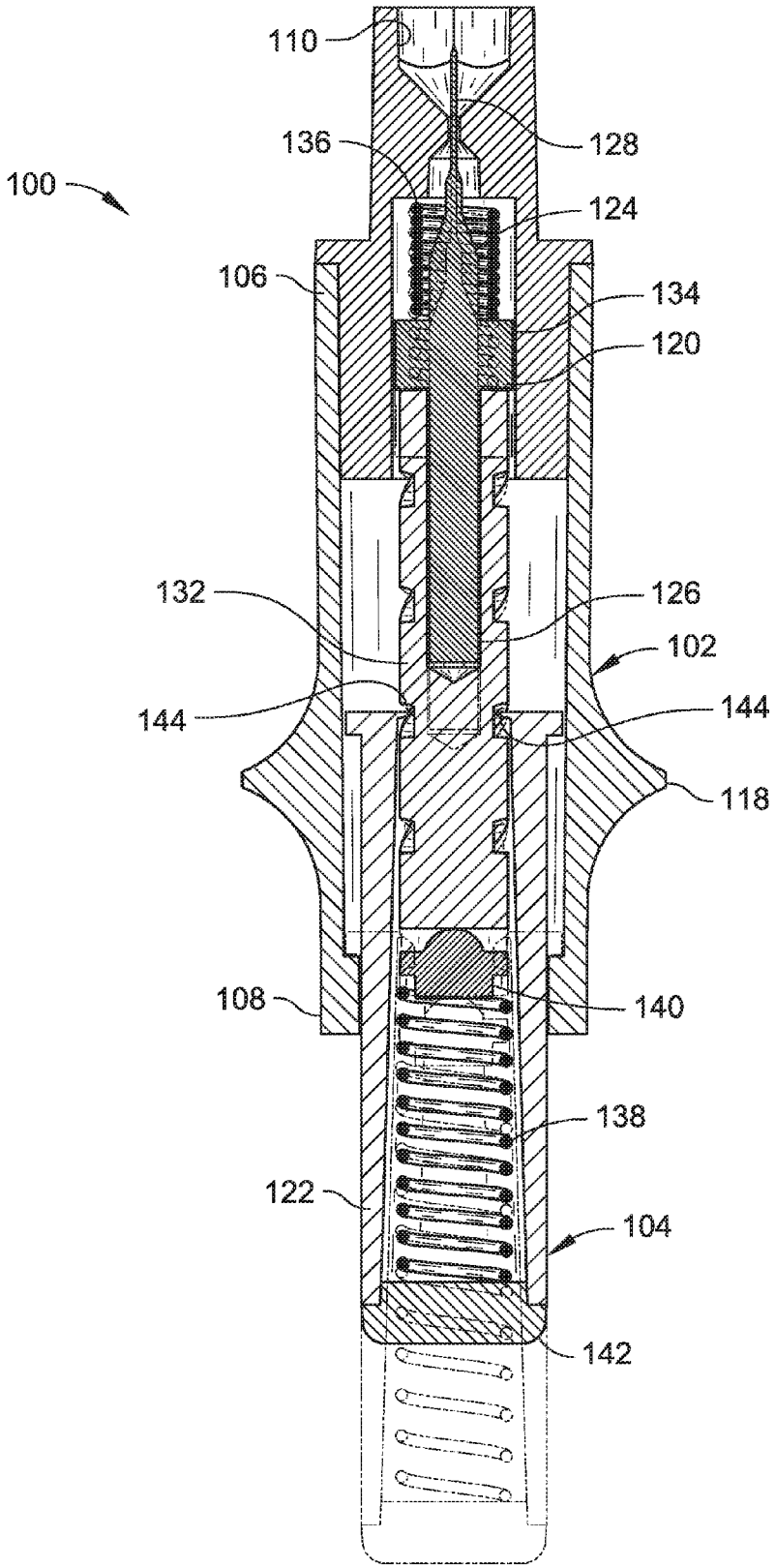
FIG. 4 is a partial cross-sectional side elevation view of the drill assembly illustrated in FIG. 2.

The second end 108 of the housing 102 can have a generally cylindrical outer surface 114 and a generally cylindrical inner surface 116, as illustrated in FIG. 2. In some embodiments, the generally cylindrical outer surface 114 of the housing 102 can include one or more protrusions and/or other holdable or grippable features (e.g., a protrusion 118) for allowing an operator to grip the drill assembly 100. For example, the protrusion 118 can be disposed proximate to the second end 108 of the housing 102. In implementations, the protrusion 118 can provide a grip that allows an operator to grasp the drill assembly 100 in a hand (e.g., between two fingers and a thumb). In this example, the operator can push on the plunger 104 using a thumb, while grasping the housing 102 using two fingers.

The second end 108 of the housing 102 is configured to receive the plunger 104. The plunger 104 can be slidably coupled with the housing 102. The plunger 104 includes a bit retainer 120 and a pusher 122. In embodiments of the disclosure, the bit retainer 120 has a first end 124 and a second end 126, where the first end 124 can be configured to retain a bit 128. In some embodiments, the bit 128 has a diameter slightly smaller than the diameter of a nozzle 130 of the printer head 112, e.g., to allow the bit 128 to fit inside the nozzle 130. For example, in an embodiment where the diameter of the nozzle 130 is about one-half of a millimeter (0.5 mm), the bit 128 can have a diameter of at least approximately four-tenths of a millimeter (0.4 mm). However, this diameter is offered by way of example only and is not meant to be restrictive of the present disclosure. In other implementations, bits 128 of other diameters can be used. In implementations, the bit 128 can be composed of metal (e.g., low carbon steel, high carbon steel, high speed steel, cobalt, tungsten carbide, diamond, etc.). Further, in some embodiments, the bit 128 can be finished with a coating material (e.g., hardened steel, titanium, black oxide, diamond powder, zirconium nitride, etc.).

The second end 126 of the bit retainer 120 can be rotateably coupled with the pusher 122. In some implementations, the bit retainer 120 can be coupled to the pusher 122 by a connector 132 configured to receive the bit retainer 120. The bit retainer 120 may have one or more protrusions 134 between the first end 124 and the second end 126. The protrusion 134 can form a rim between the first end 124 and the second end 126 so that the second end 126 can fit inside the connector 132, while the first end 124 rests atop the connector 132. In some embodiments, the protrusion 134 can be a collar or clamp, such as a chuck, a collet, and so forth, for holding and retaining the bit 128. When force is applied to the plunger 104 (e.g., pushing), the plunger 104 can engage the connector 132 to advance the bit 128 with respect to the housing 102, and rotate the bit 128 as the pusher 122 advances with respect to the housing 102. In some implementations, the bit retainer 128 can be threadably coupled to the pusher 122. For example, the bit retainer 128 can be fixedly connected (e.g., press fit) to the connector 132, and the connector 132 can be threaded to receive matching protrusions 144 on the pusher 122. In this manner, the threading on the connector 132 can be engaged by the pusher 122 so that applying force to the plunger 104 imparts a rotating movement to the bit retainer 120.

In embodiments, the drill assembly 100 can include one or more biasing members (e.g., springs) for biasing the plunger 104 and/or one or more portions of the plunger 104. In some embodiments, the drill assembly 100 can include a first biasing spring 136 and a second biasing spring 138. The spring 136 can bias the bit retainer 120 with respect to the housing 102 to resist movement of the plunger 104 to advance the bit 128 with respect to the housing 102. The spring 138 can bias the pusher 122 with respect to the bit retainer 120 to resist rotation of the bit 128 as the pusher 122 advances with respect to the bit retainer 120. The plunger 104 can also include a spring cap 140 and a pusher cap 142. The spring cap 140 separates the second biasing spring 138 from the bit retainer 120. The pusher cap 142 encloses the end of the pusher 122 so as to enclose the second biasing spring 138 within the pusher 122.

In some implementations, the drill assembly 100 can be used to clean a printer head 112, as shown in FIG. 1. The bit retainer 120 can register a printer head as described above. When force is applied to the plunger 104, the spring 136 can bias the bit retainer 120 in respect to the housing 102 and resist movement of the plunger 104 to advance the bit 128 into the nozzle 130. The spring 138 can then bias the pusher 122 with respect to the bit retainer 120. As the pusher 122 engages the threading of the connector 132, the bit retainer 120 is rotated, cleaning the printer head nozzle 130. However, the sequential operation of the springs is offered by way of example only and is not meant to be restrictive of the present disclosure. In other embodiments, the springs may operate simultaneously or in a different order (e.g., causing the bit retainer 120 to advance and rotate simultaneously). Additionally, the printer head cleaning implementation is offered by way of example only and is not meant to be restrictive of the present disclosure. In other implementations, the drill assembly 100 can be used for other drilling purposes.

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A printer head cleaner comprising:

a housing comprising a registration feature for registering a printer head with respect to the housing; and a plunger slidably coupled with the housing, the plunger including a bit retainer to retain a bit for cleaning the printer head and a pusher threadably coupled with the bit retainer, wherein pushing the plunger advances the bit with respect to the housing and rotates the bit as the pusher advances with respect to the bit retainer.

2. The printer head cleaner as recited in claim 1, wherein the housing comprises a grip allowing an operator to grasp the printer head cleaner between two fingers and a thumb.

3. The printer head cleaner as recited in claim 1, wherein the plunger is biased with respect to the housing to resist movement of the plunger to advance the bit with respect to the housing.

4. The printer head cleaner as recited in claim 3, wherein the plunger is biased with respect to the housing by a spring.

5. The printer head cleaner as recited in claim 1, wherein the pusher is biased with respect to the bit retainer to resist rotation of the bit as the pusher advances with respect to the bit retainer.

6. The printer head cleaner as recited in claim 5, wherein the pusher is biased with respect to the bit retainer by a spring.

7. A printer head cleaner comprising:

a housing comprising a registration feature for registering a printer head with respect to the housing;

a drill bit; and a plunger slidably coupled with the housing, the plunger including a bit retainer to retain the drill bit and a pusher rotateably coupled with the bit retainer, wherein pushing the plunger advances the drill bit with respect to the housing and rotates the drill bit as the pusher advances with respect to the bit retainer.

8. The printer head cleaner as recited in claim 7, wherein the pusher is threadably coupled with the bit retainer.

9. The printer head cleaner as recited in claim 7, wherein the housing comprises a grip allowing an operator to grasp the printer head cleaner between two fingers and a thumb.

10. The printer head cleaner as recited in claim 7, wherein the plunger is biased with respect to the housing to resist movement of the plunger to advance the bit the bit with respect to the housing.

11. The printer head cleaner as recited in claim 10, wherein the plunger is biased with respect to the housing by a spring.

12. The printer head cleaner as recited in claim 7, wherein the pusher is biased with respect to the bit retainer to resist rotation of the bit as the pusher advances with respect to the bit retainer.

13. The printer head cleaner as recited in claim 12, wherein the pusher is biased with respect to the bit retainer by a spring.

14. A printer head cleaner comprising:

a housing comprising a registration feature for registering a printer head with respect to the housing; and a plunger slidably coupled with the housing, the plunger including a bit retainer to retain a drill bit for cleaning the printer head and a pusher rotateably coupled with the bit retainer, wherein pushing the plunger advances the drill bit with respect to the housing and rotates the drill bit as the pusher advances with respect to the bit retainer.

15. The printer head cleaner as recited in claim 14, wherein the pusher is threadably coupled with the bit retainer.

16. The printer head cleaner as recited in claim 14, wherein the housing comprises a grip allowing an operator to grasp the printer head cleaner between two fingers and a thumb.

17. The printer head cleaner as recited in claim 14, wherein the plunger is biased with respect to the housing to resist movement of the plunger to advance the bit with respect to the housing.

18. The printer head cleaner as recited in claim 17, wherein the plunger is biased with respect to the housing by a spring.

19. The printer head cleaner as recited in claim 14, wherein the pusher is biased with respect to the bit retainer to resist rotation of the bit as the pusher advances with respect to the bit retainer.

20. The printer head cleaner as recited in claim 19, wherein the pusher is biased with respect to the bit retainer by a spring.

* * * * *